US005485687A

United States Patent [19]

Rohde

[11] Patent Number: 5,485,687

[45] Date of Patent: Jan. 23, 1996

[54] ANTI-SLIP SHOE ATTACHMENT DEVICE

[76] Inventor: Gilbert Rohde, Box 97, New Towne, N. Dak. 58763

[21] Appl. No.: 218,431

[22] Filed: Mar. 28, 1994

[51] Int. Cl.[6] ..... A43C 15/00

[52] U.S. Cl. ..... 36/62; 36/7.7; 36/7.4; 36/59 R

[58] Field of Search ..... 36/62, 67 D, 7.7, 36/7.6, 7.2, 7.4, 66, 59 R

[56] References Cited

U.S. PATENT DOCUMENTS

| | | | |
|---|---|---|---|
| 2,076,260 | 4/1937 | Anshelm | 36/62 |
| 2,166,958 | 7/1939 | Lawson | 36/62 |
| 4,286,396 | 9/1981 | Deacon | 36/62 |
| 4,702,021 | 10/1987 | Cameron | 36/62 |

FOREIGN PATENT DOCUMENTS

| | | | |
|---|---|---|---|
| 0143833 | 6/1935 | Austria | 36/62 |
| 2039611 | 10/1992 | Canada | 36/62 |

*Primary Examiner*—Steven N. Meyers
*Assistant Examiner*—Ted Kavanaugh
*Attorney, Agent, or Firm*—Michael I. Kroll

[57] ABSTRACT

An anti-slip attachment device is provided for a shoe having a sole and a vamp, which consists of a plate to fit against the bottom of the sole of the shoe. A component is for mounting the plate in a removable manner against the bottom of the sole of the shoe, so that the plate when mounted will be in a stationary position with respect to the sole. A structure on the bottom of the plate is for preventing the sole of the shoe from slipping on an icy surface.

1 Claim, 2 Drawing Sheets

Fig. 1
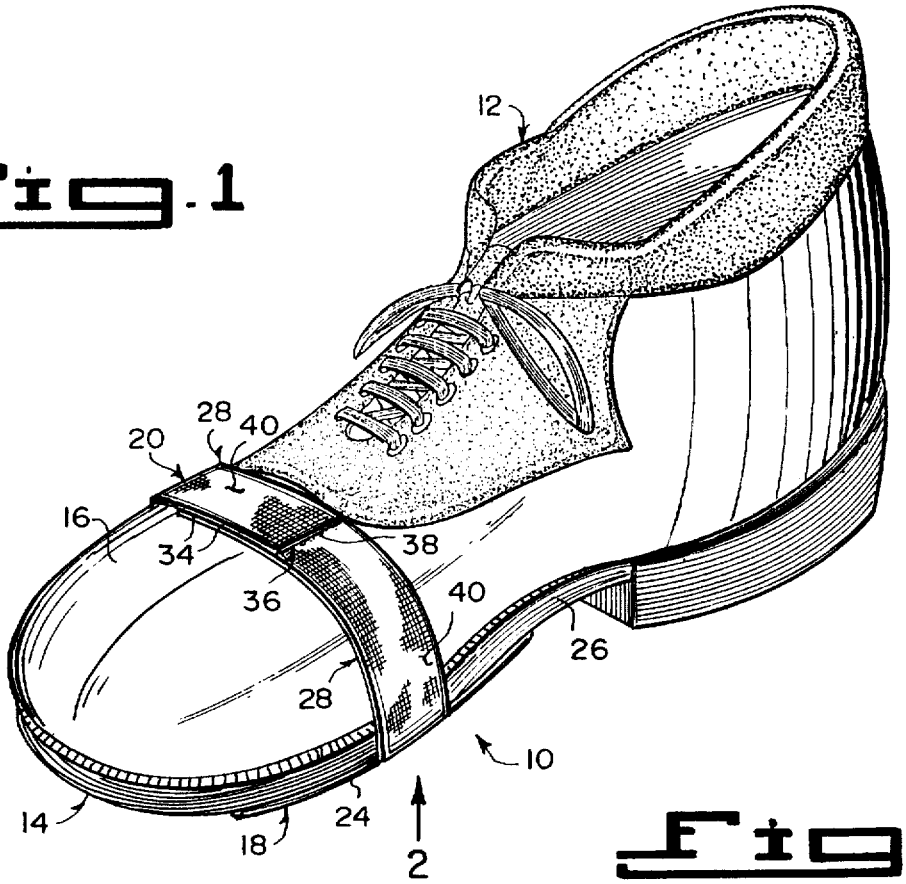
Fig. 2
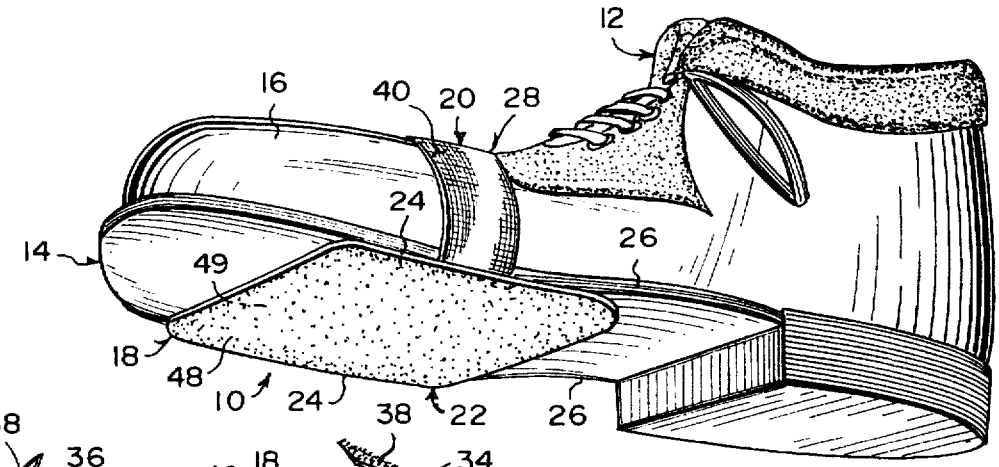
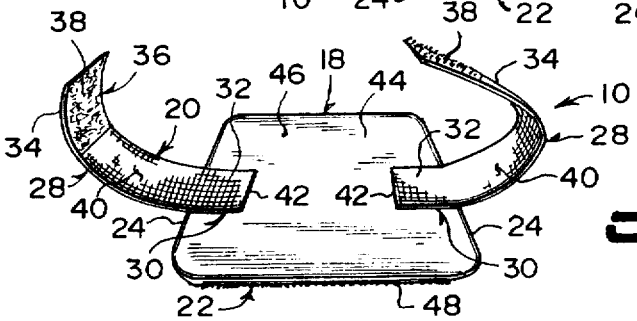
Fig. 3

ANTI-SLIP SHOE ATTACHMENT DEVICE

BACKGROUND OF THE INVENTION

1. Field of the Invention

The instant invention relates generally to traction improving apparatuses and more specifically it relates to an anti-slip shoe sole attachment device.

2. Description of the Prior Art

Numerous traction improving apparatuses have been provided in prior art that are adapted to be attached to shoes and boots for giving the wearer surer footing. While these units may be suitable for the particular purpose to which they address, they would not be as suitable for the purposes of the present invention as heretofore described.

SUMMARY OF THE INVENTION

A primary object of the present invention is to provide an anti-slip shoe sole attachment device that will overcome the shortcomings of the prior art devices.

Another object is to provide an anti-slip shoe sole attachment device that is mounted in a removable manner to the bottom of a sole of a shoe to prevent a person from slipping on an icy surface.

An additional object is to provide an anti-slip shoe sole attachment device that includes a plate having coarse grit, stables or teeth to engage with the icy surface and straps to extend about the vamp of the shoe to hold the plate in a stationary position to the bottom of the sole.

A further object is to provide an anti-slip shoe sole attachment device that is simple and easy to use.

A still further object is to provide an anti-slip shoe sole attachment device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a top perspective view of a shoe with a first embodiment of the instant invention mounted thereto.

FIG. 2 is a bottom perspective view taken in the direction of arrow 2 in FIG. 1, showing the coarse grit on the plate.

FIG. 3 is a top perspective view of the first embodiment per se.

DETAILED DESCRIPTION OF THE PREFERRED EMBODIMENTS

Figure 4:
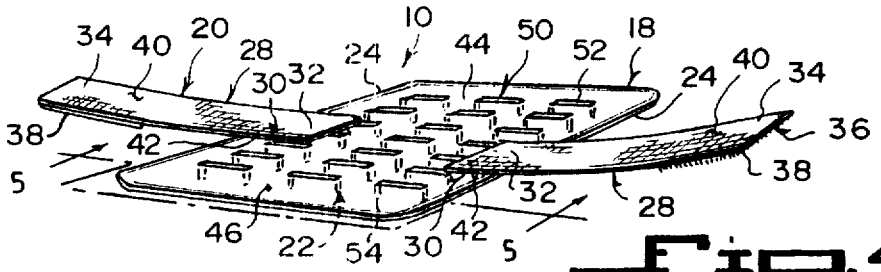
FIG. 4 is a top perspective view of a second embodiment of the instant invention per se.

Turning now descriptively to the drawings, in which similar reference characters denote similar elements throughout the several views, FIGS. 1 through 8 illustrate an anti-slip attachment device 10 for a shoe 12 having a sole 14 and a vamp 16. The device 10 consists of a plate 18 to fit against the bottom of the sole 14 of the shoe 12. A component 20 is for mounting the plate 18 in a removable manner against the bottom of the sole 14 of the shoe 12, so that the plate 18 when mounted will be in a stationary position with respect to the sole 14. A structure 22 on the bottom of the plate 18 is for preventing the sole 14 of the shoe 12 from slipping on an icy surface.

The plate 18 is sized to extend across the width of the sole 14 of the shoe 12, so that each side 24 of the plate 18 can be properly aligned with each edge 26 of the sole 14. The mounting component 20 contains a pair of straps 28. An element 30 is for attaching a first end 32 of each strap 28 adjacent to one side 24 of the plate 18, so that the straps 28 are opposite from each other and can extend over the vamp 16 of the shoe 12, with their second ends 34 overlapping. A mechanism 36 is for detachably connecting the second overlapping ends 34 of the straps 28 together.

The detachably connecting mechanism 36 includes a mating hook and loop pile fastener 38. Each strap 28 is fabricated out of an elastic webbing material 40, so as to fit snugly over the vamp 16 of the shoe 12.

The attaching element 30 for the first end 32 of each strap 28 is adhesive material 42, applied between the first end 32 and a top surface 44 of the plate 18 adjacent to one side 24 thereof. The plate 18, shown in FIGS. 1 through 5, is fabricated out of a rubberized canvas material 46. The slipping preventing structure 22 in FIGS. 1 through 3, is a coarse grit material 48 glued to the bottom 49 of the plate 18.

Figure 5:
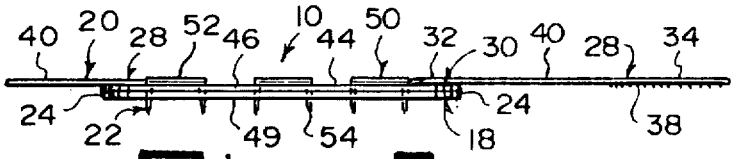
FIG. 5 is an end view taken in the direction of arrows 5—5 in FIG. 4, showing the staples extending through the plate.

In FIGS. 4 and 5, the slipping preventing structure 22 consists of a plurality of staples 50, each having a crown 52 and a pair of pointed legs 54. Each staple 50 is inserted through the plate 18, so that the crown 52 sits on the top 44 of the plate 18, while the pointed legs 54 protrude through the bottom 49 of the plate 18.

Figure 6:
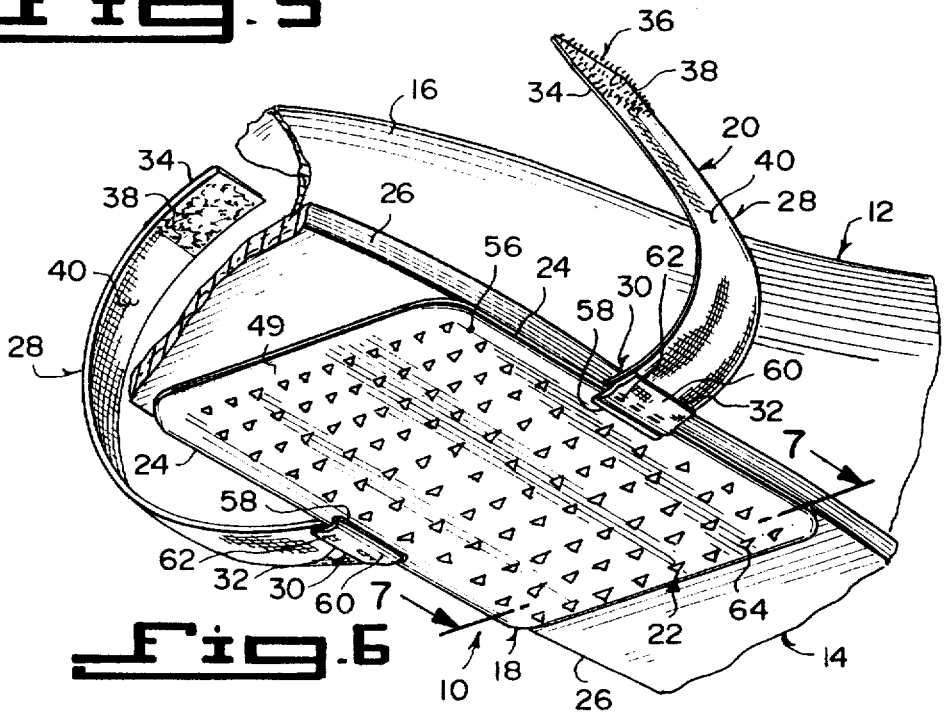
FIG. 6 is a bottom perspective view of a shoe with parts broken away of a third embodiment of the instant invention ready to be mounted thereto.
Figure 7:
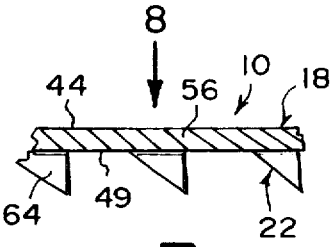
FIG. 7 is a cross sectional view taken along line 7—7 in FIG. 6 of a portion of the plate showing the teeth in greater detail.
Figure 8:
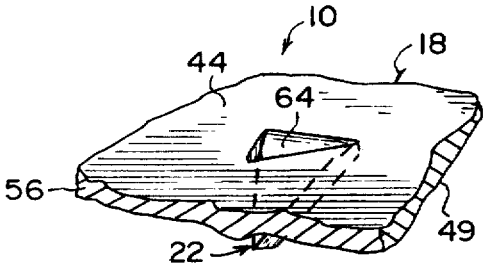
FIG. 8 is a top perspective view of a portion of the plate taken in the direction of arrow 8 in FIG. 7.

In FIGS. 6, 7 and 8, the plate 18 is fabricated out of metal material 56 and has a pair of slots 58, each adjacent to one side 24 of the plate 18. The attaching element 30 for the first end 32 of each strap 28, includes a first end 32 inserted through the respective slot 58 in the plate 18 and folded over to form a loop 60. A stitched thread 62 goes through the loop 60 of the first end 32, to retain the strap 28 to the plate 18. The slipping preventing structure 22 consists of a plurality of cleats 64. Each cleat 64 is punched into the plate 18 and bent downwardly, so that each cleat 64 will extend below the plate 18.

OPERATION OF THE INVENTION

To use the anti-slip attachment device 10 the following steps should be taken:

1. Place the plate 18 against the bottom of the sole 14 of the shoe 12.
2. Pull the straps 28 over the vamp 16 of the shoe 12.
3. Press the mating hook and loop pile fastener 38 together at the overlapping second ends 34 of the straps 28, to hold the plate 18 stationary.
4. If the bottom 49 of the plate 18 has the coarse grit material 48 thereto, it will make contact with the icy surface, to prevent slippage of the sole 14 of the shoe 12.

5. If the plate 18 has the staples 50 therethrough, the pointed legs 54 will make contact with the icy surface, to prevent slippage of the sole 14 of the shoe 12.
6. If the bottom 49 of the plate 18 has the cleats 64 extending downwardly, they will make contact with the icy surface, to prevent slippage of the sole 14 of the shoe 12.
7. To remove the plate 18, simply separate the mating hook and loop pile fastener 38 and take the straps 28 off of the vamp 16 of the shoe 12.

LIST OF REFERENCE NUMBERS 10 anti-slip attachment device
12 shoe
14 sole
16 vamp
18 plate
20 mounting component
22 slipping preventing structure
24 side of 18
26 edge of 14
28 strap
30 attaching element
32 first end of 28
34 second end 28
36 detachably connecting mechanism
38 mating hook and loop pile fastener
40 elastic webbing material for 28
42 adhesive material for 30
44 top surface of 18
46 rubberized canvas material for 18
48 coarse grit material on 18
49 bottom of 18
50 staple
52 crown
54 pointed leg
56 metal material for 18
58 slot in 18
60 loop formed on 32
62 stitched thread in 60
64 cleat It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An anti-slip attachment device for and in combination with a shoe having a sole with a flat bottom and a vamp, which comprises:

a) a plate fabricated out of a rubberized canvas material fitted against the flat bottom of the sole of the shoe, said plate being sized to extend across the width of the sole of the shoe, so that each side of said plate can be properly aligned with each edge of the sole;

b) means for mounting said plate in a removable manner against the bottom of the sole of the shoe, said mounting means comprising a pair of straps of elastic webbing material, said means including adhesive material for attaching a first end of each said strap adjacent to one side of said plate, so that said straps are opposite from each other and can extend over the vamp of the shoe, with their second ends overlapping, and means including a mating hook and loop pile fastener on the overlapping second ends of said straps for connecting the two straps together, so that said plate when mounted will be in a stationary position with respect to the sole; and c) means on the bottom of said plate for preventing the sole of the shoe from slipping on an icy surface comprising a plurality of staples, each having a crown and a pair of pointed legs, in which each said staple is inserted through said plate, so that the crown sits on the top of said plate and in contact with said flat bottom of said sole, while the pointed legs protrude through the bottom of said plate.

* * * * *